US012781584B2

(12) United States Patent
Branković et al.

(10) Patent No.: US 12,781,584 B2
(45) Date of Patent: Nov. 3, 2026

(54) GRADED FILTER-SEPARATOR AND METHOD FOR USE

(71) Applicants: Altus Intervention (Technologies) AS, Stavanger (NO); Baker Hughes Oilfield Operations, LLC, Houston, TX (US)

(72) Inventors: Maša Branković, Oslo (NO); Espen Osaland, Sandnes (NO); Siamak Sand, Oslo (NO)

(73) Assignees: Baker Hughes Ollfiled Operations, Houston, TX (US); Altus Intervention (Technology) AS, Stavanger (NO)

( * ) Notice: Subject to any disclaimer, the term of this patent is extended or adjusted under 35 U.S.C. 154(b) by 0 days.

(21) Appl. No.: 19/173,267

(22) Filed: Apr. 8, 2025

(65) Prior Publication Data

US 2025/0320786 A1 Oct. 16, 2025

(30) Foreign Application Priority Data

Apr. 10, 2024 (NO) ..... 20240342

(51) Int. Cl.
*E21B 27/00* (2006.01)
*E21B 43/08* (2006.01)

(52) U.S. Cl.
CPC ..... *E21B 27/005* (2013.01); *E21B 43/082* (2013.01)

(58) Field of Classification Search
CPC ..... E21B 27/005; E21B 43/082
See application file for complete search history.

(56) References Cited

U.S. PATENT DOCUMENTS 2,748,719 A 6/1956 Wells
3,023,810 A * 3/1962 Anderson ..... E21B 27/005 166/227
3,556,219 A 1/1971 Meldau
5,107,927 A * 4/1992 Whiteley ..... E21B 17/10 166/227
6,250,387 B1 6/2001 Carmichael et al.
(Continued)

FOREIGN PATENT DOCUMENTS

CN 108756832 A 11/2018
CN 208430991 U 1/2019
(Continued)

*Primary Examiner* — Tara Schimpf
*Assistant Examiner* — Daniel T Craig
(74) *Attorney, Agent, or Firm* — GableGotwals

(57) ABSTRACT

A collecting device for collecting debris within a wellbore, the collecting device comprises a leading portion, a trailing portion, a wall connecting the leading portion to the trailing portion, a collecting chamber on an inside of the wall, an inlet at the leading portion, an outlet at the trailing portion, and an elongated filter, the collecting device forms a device longitudinal central axis, wherein the elongated filter extends along the central axis and forms a first end portion and a second end portion, wherein the first end portion has a first permeability and the second end portion has a second permeability, the second end portion is positioned closest to the inlet, the elongated filter forms a retentate side and permeate side. A downhole toolstring and a method for collecting the debris from the wellbore are also disclosed.

23 Claims, 6 Drawing Sheets

(56) References Cited

U.S. PATENT DOCUMENTS

Figure 1A:
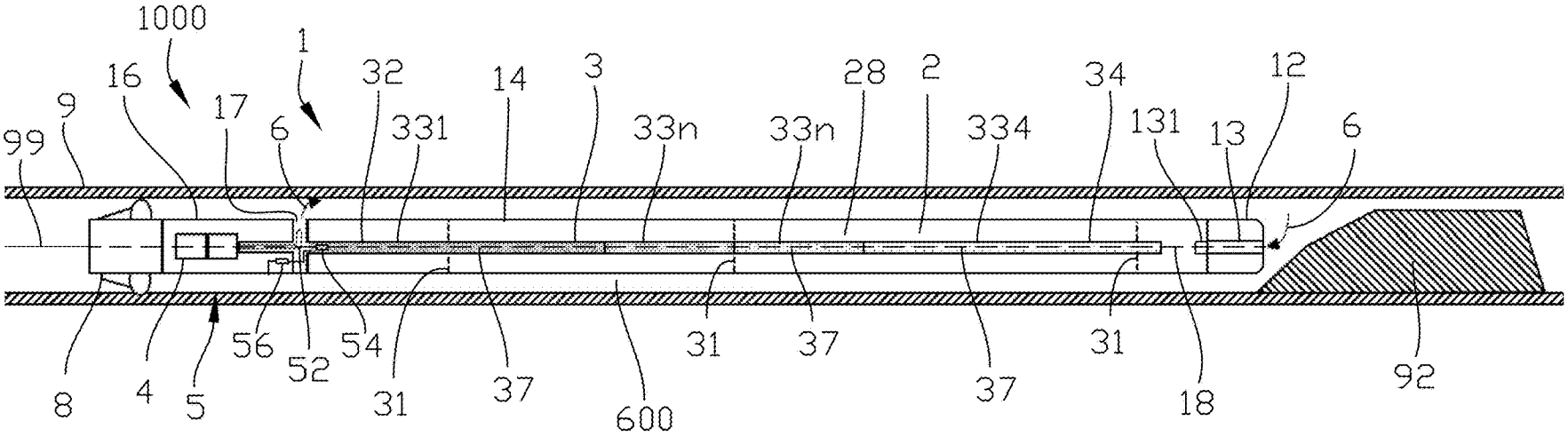

| | | | | |
|---|---|---|---|---|
| 7,866,384 | B2 * | 1/2011 | Hall | E21B 17/1057 166/241.1 |
| 9,890,605 | B2 * | 2/2018 | Juhlin | E21B 27/005 |
| 11,236,566 | B2 * | 2/2022 | Toge | E21B 27/005 |
| 2002/0104655 | A1 | 8/2002 | Hurst et al. | |
| 2004/0050217 | A1 | 3/2004 | Heijnen et al. | |
| 2007/0246212 | A1 * | 10/2007 | Richards | E21B 43/121 166/227 |
| 2007/0256834 | A1 | 11/2007 | Hopkins et al. | |
| 2010/0018775 | A1 | 1/2010 | Hallundbaek et al. | |
| 2011/0120721 | A1 | 5/2011 | Paulsen | |
| 2014/0014357 | A1 * | 1/2014 | Riisem | E21B 43/12 166/227 |
| 2015/0218901 | A1 | 8/2015 | Juhlin | |
| 2015/0321125 | A1 | 11/2015 | Jenkins et al. | |
| 2017/0328158 | A1 | 11/2017 | Hanson et al. | |
| 2019/0257165 | A1 | 8/2019 | Toge et al. | |
| 2021/0164310 | A1 | 6/2021 | Head et al. | |
| 2022/0220827 | A1 | 7/2022 | Haugland et al. | |
| 2022/0341296 | A1 * | 10/2022 | Flores Perez | B22F 3/1109 |

FOREIGN PATENT DOCUMENTS

| | | | |
|---|---|---|---|
| CN | 114427386 | A | 5/2022 |
| WO | 2008058540 | A1 | 5/2008 |

* cited by examiner

GRADED FILTER-SEPARATOR AND METHOD FOR USE

CROSS-REFERENCE TO RELATED APPLICATIONS

This United States application claims priority to Norwegian Patent Application No. 20240342 filed 10 Apr. 2024, which is incorporated herein by reference.

The invention relates to a downhole tool used for collecting debris from within a wellbore and bringing the debris out of the wellbore. More particularly, the collecting device comprises a leading portion, a trailing portion, a wall connecting the leading portion to the trailing portion, a collecting chamber on an inside of the wall, an inlet at the leading portion, an outlet at the trailing portion, and an elongated filter. A downhole toolstring comprising the collecting device and a method for collecting debris within the wellbore is also disclosed.

In the oil and gas industry, well-intervention operations are routinely performed to maintain high production levels. Over time, deposits such as sand, rust, and other debris may accumulate within the wellbore, potentially reducing or even halting production flow. Consequently, debris collection operations may be conducted to remove the debris and restore production efficiency.

The efficiency of debris collection is crucial to minimize production downtime. Additionally, the length of the toolstring used for debris collection is often constrained by the length of a sluice equipment, also known as a lubricator, which safely sluices the toolstring into and out of the wellbore. Therefore, it is essential that the debris collecting device captures as much debris as possible in each collection run.

Document WO2008/058540 describes a fluid cleaner tool equipped with an elongated filter within a chamber. This tool is designed to be moved to the location of the debris within the wellbore. A centrifugal pump draws a fluid containing the debris into the chamber, where the debris is separated from the fluid by the elongated filter. The filtered fluid is then returned to the wellbore, while the debris remains within the chamber.

Similarly, document US2010018775 describes a drilling tool equipped with a fluid cleaner. This cleaner features a pump that draws a fluid containing debris into a chamber, where the debris is separated from the fluid by an elongated filter. The debris is collected within the chamber, while the filtered fluid, the permeate, exits the cleaner through an outlet.

Both documents describe that during debris collection, the debris tends to adhere to or stick to the filter near the chamber's inlet. This means that any remaining debris to be collected must flow past the already collected debris in a passage between the collected debris and the chamber wall. This passage restricts the flow of fluid containing debris, which may increase the power required for debris collection. Certain types of debris may cause the collected debris to block the passage between the inlet and an unclogged part of the elongated filter, thereby preventing the chamber from being filled. For other types of less sticky debris, and if the elongated filter is long, it is nearly impossible to fill the chamber fully. This is due to the passage required for debris to be displaced past a clogged portion of the filter and to a part of the filter not yet clogged by the collected debris. When a portion of the elongated filter at the end opposite the inlet eventually gets clogged by debris, the passage past the already collected debris remains, resulting in the chamber not being filled completely.

The invention has for its object to remedy or to reduce at least one of the drawbacks of the prior art, or at least provide a useful alternative to prior art. The object is achieved through features, which are specified in the description below and in the claims that follow. The invention is defined by the independent patent claim. The dependent claims define advantageous embodiments of the invention.

In a first aspect the invention relates more particularly to a collecting device for collecting debris within a wellbore, the collecting device comprises a leading portion, an opposite trailing portion, a wall connecting the leading portion to the trailing portion, a collecting chamber on an inside of the wall, an inlet at the leading portion, an outlet at the trailing portion, and an elongated filter, the collecting device forms a device longitudinal central axis between the leading portion and the trailing portion, wherein:

- the elongated filter extends along the device longitudinal central axis and forms a first end portion and an opposite second end portion, wherein the elongated filter at the first end portion is formed with a first permeability and the elongated filter at the second end portion is formed with a second permeability;
- the second end portion is positioned closest to the inlet;
- the elongated filter forms a retentate side and a permeate side; and
- the permeate side of the elongated filter is fluidly connected with the outlet.

A downhole toolstring comprising the collecting device may be connected to a surface equipment via an elongated flexible member. The trailing portion may form a connection between the collecting device and the surface equipment via the elongated flexible member. A cable head adapted to be connected to an electrical wireline, a coiled tubing, or a drill pipe may form the connection between the trailing portion and the elongated flexible member. The elongated flexible member may be a wireline, a slick line, a coiled tubing provided with an electrical conductor, or a drill pipe provided with an electrical conductor.

The downhole toolstring may include one or more of the following: a cable head, a swivel, a release tool, a tension and compression sensor, or a propulsion device that may provide a propulsive force to move the collecting device within the wellbore, or any other suitable downhole tool known in the art. The propulsion device may be wireline operated and may be a tractor, a stroker, or a combination. The tractor and the stroker is known tools within the art. The leading portion is located at a distal end of the collecting device relative to the trailing portion.

To collect debris within the wellbore, a wellbore fluid may be displaced relative to the collecting device to create a fluid flow near the leading portion, e.g., in the inlet. The leading portion may be positioned proximate, close to, near, adjacent to, or abutting the debris to be collected. The debris to be collected may mix with or suspend in the fluid flow. The fluid flow containing the debris may then enter the collecting device through the inlet and into the collecting chamber. For debris that is fluid in nature, the leading portion may be submerged or buried within the debris, where the fluid flow may be formed by the fluid debris itself.

The inlet may comprise a check valve that allows the fluid flow containing the debris to enter the collecting chamber. Once the debris is collected within the chamber, the check valve prevents the debris from escaping into the wellbore again. The check valve may be a ball valve, a flapper valve, or any other suitable check valve. In one embodiment, the inlet may comprise a duckbill valve. The duckbill valve, which has no moving parts such as a spring, a ball, or a flapper, has self-cleaning properties that allow it to handle suspended solids in the fluid flow without the risk of clogging. The self-cleaning property is due to the closing motion that dislodges any accumulated debris in the valve. The power supplied from the surface equipment to the collecting device may be limited by the elongated flexible member, such as a current through the wireline or a fluid flow through the coiled tubing. The duckbill valve, which has a lower head loss compared to other check valves, reduces the power required to create the fluid flow through the inlet. Another feature of the duckbill valve is that it operates as a result of a pressure difference across the valve, requiring no intervention to open or close. The higher the reverse pressure, the tighter the duckbill valve closes. This greatly simplifies the inlet. The unique design of the duckbill valve eliminates the need for maintenance and reduces the risk of leakage, clogging, and mechanical failure compared to traditional valves such as ball valves and flapper valves. These are important features for downhole equipment exposed to many unforeseen and environmental challenges.

Within the collecting chamber, the fluid flow containing the debris may continue to move towards the elongated filter. The elongated filter, which may be porous and may comprise openings or passages, allows the wellbore fluid to pass through the elongated filter as permeate while preventing a coarse debris, the retentate, from doing so. The coarse debris, which may be defined as being larger than the openings or passages in the elongated filter, remains within the collecting chamber on one side of the elongated filter, i.e., the retentate side, while the fluid passes through the elongated filter and out on the permeate side. The permeate side of the elongated filter is fluidly connected to the outlet, as previously mentioned. The permeate side being fluidly connected to the outlet may be achieved through an arrangement of pipes, hoses, sensors, and other arrangements known within the art. The fluid flow, now comprising a filtered fluid, exits the collecting device through the outlet and into the surrounding wellbore.

The retentate may be defined as the collected debris, separated from the fluid flow by the elongated filter. The retentate, or the collected debris, may comprise solid particles such as sand or gravel. However, the retentate may also be fluid debris possessing properties that allow the elongated filter to filter it from the wellbore fluid.

If the production flow in a section of the wellbore where debris is to be collected is minimal, the filtered fluid may exit the outlet, continue along an exterior of the collecting device, and return to the inlet. This creates a fluid flow loop, reusing a significant portion of the wellbore fluid to create the fluid flow in the inlet. In wellbores where the production flow is larger, the filtered fluid may flow towards the surface with the production flow after exiting the outlet.

The elongated filter may have a cylindrical shape, which is beneficial for the fluid flow as it ensures uniform flow characteristics around the cylindrical form. In an embodiment, the elongated filter may have a non-cylindrical form, such as a star which may delay clogging due to the varying geometry around the circumference. The filter may comprise a star pleated element. A filter area, where the fluid flow may pass through the elongated filter, may be increased with minimal complexity by extending a filter length and/or increasing a filter diameter. The elongated filter may comprise a single filter element. The elongated filter may comprise a plurality of filter elements connected together head to tail to form the elongated filter. The elongated filter may be positioned within the collecting device using one support or a plurality of supports. The support may comprise one or a plurality of arms, a frame, or any other suitable supportive structure known in the art that may provide support between the wall and the elongated filter.

The permeability of the elongated filter, influenced by the openings or the passages between the retentate side and the permeate side (i.e., the porosity of the elongated filter), affects the fluid flow and the passage of a finer debris. A filter area of large permeability allows less restricted fluid flow and passage of the finer debris compared to a filter area of less permeability. The finer debris may be defined as having a smaller size than the openings or passages. The fluid flow naturally tends to flow through filter areas with the least restriction, meaning if permeability varies along the elongated filter, the fluid flow will primarily flow towards and through a portion with larger permeability and less through a portion with less permeability. Therefore, the fluid flow within the collecting chamber may be controlled by configuring the permeability between the first end portion and the second end portion of the elongated filter. The elongated filter may comprise a plurality of permeabilities between the first end portion and the second end portion. This allows more precise control of the fluid flow within the collecting chamber and optimization for the type of debris being collected from the wellbore. The permeability of the elongated filter may change linearly along its length, it may change in steps, or by a combination of linear change and stepped change.

The first permeability may be larger compared to the second permeability. This results in the fluid flow containing the debris initially being directed to the first end portion, i.e., an end of the collecting chamber opposite the inlet, before the fluid flow enters the elongated filter. Initially, the elongated filter may deposit the coarse debris within the collecting chamber adjacently to or abutting to the first end portion of the elongated filter. The finer debris may initially be allowed to pass through the elongated filter and back into the wellbore. The fluid flow between the outlet and the inlet may displace the finer debris back to the inlet. As the coarse debris may still allow the fluid flow containing the debris to pass, the coarse debris particles may now act as a filter. Therefore, the finer debris in the fluid flow may then be collected within the coarse debris, thus improving the fill percentage of the collecting chamber. As the finer debris clogs the coarse debris near the first end portion, the fluid flow continues to flow through an unrestricted portion of the elongated filter now situated closer to the second end portion, i.e., closer to the inlet. The process of collecting the coarse debris and the finer debris within the collecting chamber continues and progresses towards the second end portion of the elongated filter. When the second end portion of the elongated filter is eventually clogged by debris, the collecting chamber is completely filled.

As previously described, if the production flow is sufficiently high, the filtered fluid that may contain the finer debris may not continue along the outside of the collecting device towards the inlet. Instead, the filtered fluid containing the finer debris may follow the production flow to the surface, as the finer debris may be light enough to suspend into and follow the production flow. Since the finer debris is not collected within the collecting device, but still removed from the wellbore in this case, this may increase the efficiency of the collection operation.

An annular collecting space may be formed between the retentate side of the elongated filter and the wall. The retentate side of the elongated filter may form an inner boundary of the annular collecting space. The wall may form an outer boundary of the annular collecting space. In one embodiment, the wall, the leading portion, and the trailing portion may form or at least form a portion of an outer boundary of the collecting chamber. The retentate side of the elongated filter may form at least a portion of an inner boundary of the collecting chamber. Consequently, the debris to be collected may be collected around the elongated filter and within the annular collecting space. In an embodiment where the elongated filter does not extend to the inlet, the debris may additionally be collected between the second end portion and the inlet.

Debris that is easy to collect, such as sand or gravel, may require a shorter filter length and smaller filter diameter compared to more adhesive and difficult-to-collect types of debris. The collecting device may be configured to be adapted for the debris to be collected.

In an embodiment, the elongated filter may extend from the leading portion to the trailing portion, i.e., throughout a length of the collecting chamber. The inlet may be adapted to direct the fluid flow into the collecting chamber such that the fluid enters the collecting chamber on the retentate side of the elongated filter. Depending on the configuration and position of the elongated filter, the inlet may be offset or angled relative to the device longitudinal central axis, or it may align with the device longitudinal central axis. The inlet may comprise a single conduit or alternatively a plurality of conduits arranged offset from the device longitudinal central axis.

The filter length may be shorter than the collecting chamber. In this case, the annular collecting space may form within a portion of the collecting chamber, i.e., between the first end portion and the second end portion of the elongated filter. A shorter elongated filter allows for the collection of more debris within the collecting chamber compared to a longer elongated filter. The elongated filter may extend between 30 and 100 percent of the length of the collecting chamber, between 50 and 100 percent of the length, or between 60 and 90 percent of the length. The filter length, the filter diameter, and the permeability may be determined based on the type of debris to be collected, as understood by a skilled person in the art.

In an embodiment where the elongated filter forms the annular collecting space within the collecting chamber, it may be challenging to completely fill the collecting chamber in some wellbores. Most wellbores have a vertical section that may transition into a deviated section. When the collecting device is positioned inside the deviated part of the wellbore, the collecting chamber may be divided into an upper portion and a lower portion. Using a watch-face analogy, the upper portion corresponds to a sector from 9 o'clock to 3 o'clock, and the lower portion corresponds to a sector from 3 o'clock to 9 o'clock. The uppermost high side position within the collecting chamber is therefore at the 12 o'clock position, and the lowermost low side position is at the 6 o'clock position. Due to gravity, the debris tends to settle in the lower portion of the collecting chamber in the deviated sections of the wellbore. Therefore, it may be difficult to fill the upper portion of the collecting chamber. This may be due to the collected debris forming a passage in the upper portion within the annular collecting space. The passage may form as debris settles over the elongated filter due to gravity and may clog the elongated filter prematurely before the annular collecting chamber is completely filled.

The elongated filter may be in an offset position from the device longitudinal central axis. The offset position may be such that the elongated filter is adjacent to or abutting the wall. Despite a minimal distance between the elongated filter and the wall in the region where the elongated filter abuts the wall, the annular collecting space is still deemed to be formed. The collecting device, comprising the elongated filter at the offset position, may therefore be rotated and oriented around the device longitudinal central axis within the deviated part of the wellbore such that the elongated filter is positioned in the uppermost high side position within the collecting chamber. The annular collecting space may be defined by a gap between the elongated filter and the wall. The gap may be small in the uppermost high side position. The gap may become progressively larger on each side of the elongated filter until the gap becomes largest in the lowermost low side position, i.e., the 6 o'clock position. As the debris is collected within the annular collection chamber, gravity may settle the collected debris in the lower portion of the collecting chamber. Once the lower portion is filled, the debris may start to encompass portions of the elongated filter. The collecting chamber may therefore be fully filled with no unfilled passages.

In a near-vertical section of the wellbore, it may be advantageous to position the elongated filter along the device's longitudinal central axis. Conversely, in a horizontal section of the wellbore, the offset position may be desirable so that the elongated filter is adjacent to the wall. Debris may be collected from various sections within the wellbore, each with different deviations. Therefore, it may be beneficial to adjust the offset position of the elongated filter based on the wellbore's deviation and the type of debris to be collected.

In one embodiment, the collecting device may comprise a support. The support may be adapted to maintain the offset position of the elongated filter and/or to adjust the offset position of the elongated filter from the device longitudinal central axis. The support may comprise a support-feature adapted to position the elongated filter at a support distance. The support distance may be a distance between the wall and the elongated filter. The adjustment of the offset position may be achieved by modifying or replacing one or more supports. In an embodiment where the support-feature includes an arm, the arm may be adjusted to alter the support distance between the wall and the elongated filter. In an embodiment of the support, the support feature may comprise a frame forming a fixed support distance. A support with a first fixed support distance may be replaced by another support that establishes a second support distance. The first and the second support distances may be different, thereby changing the offset position of the elongated filter.

If the debris to be collected is sticky and challenging to collect, a larger filter area may be desirable. The elongated filter may be configured within the collecting chamber such that an annular clean space is formed between the permeate side of the elongated filter and the wall. The elongated filter may extend from the leading portion towards the trailing portion. The elongated filter may extend from the leading portion to the trailing portion, forming the annular clean space along the length of the collecting chamber. In this embodiment, the outer boundary or at least a portion of the outer boundary of the collecting chamber may be formed by the retentate side of the elongated filter, and the leading portion. In an embodiment, the trailing portion may additionally form part of the outer boundary of the collecting chamber.

In an embodiment, the elongated filter may extend through a portion of the collecting chamber such that the annular clean space does not extend from the leading portion to the trailing portion. In this embodiment, the outer boundary or at least a portion of the outer boundary of the collecting chamber may be formed by the retentate side of the elongated filter, the wall, the leading portion, and additionally in some embodiments, the trailing portion. When the annular clean space is formed, the permeate side of the elongated filter may at least partially face the wall. In an embodiment, a portion of the permeate side of the elongated filter may face the trailing portion. Thus, the elongated filter may at least partially encapsulate the collecting chamber.

The elongated filter forming the annular clean space may increase the filter area compared to an embodiment where the annular collecting space is formed. In an embodiment comprising the annular clean space, the collection of debris may be performed as follows: The fluid flow containing the debris may enter the collecting chamber through the inlet and flow to a region of the elongated filter with the largest permeability, e.g., the first end portion. The fluid flow may then enter the retentate side of the elongated filter facing towards the device longitudinal central axis. The filtered fluid may then exit the permeate side of the elongated filter and flow in the annular clean space created between the permeate side of the elongated filter and the wall before the fluid exits the collecting device through the outlet.

The collecting device may be operated on any toolstring capable of creating a fluid flow in the inlet. The fluid flow may be created remotely from the collecting device, such as in coil-tubing or drill pipe operations, or within the collecting device itself. In a modular downhole tool system, the collecting device may be connected to a module designed to create the fluid flow. The collecting device may preferably be wireline-operated, with the fluid flow created within the downhole toolstring.

The collecting device may comprise a pumping system configured to form the fluid flow from the wellbore and into the collecting chamber via the inlet. The pumping system may comprise a pump, such as a centrifugal pump, a progressive cavity pump, or any other suitable pump known in the art. The collecting device may comprise a motor adapted to energise the pumping system. The motor may be an electric motor, a hydraulic motor, or any other suitable motor for energizing the pumping system.

As previously described, the wellbore fluid may be displaced to create the fluid flow, and the debris to be collected may mix or suspend within this fluid flow. A suction side of the pumping system, where the pumping system draws fluid from, may be defined as an inlet side of the pumping system. A discharge side of the pumping system, where the fluid being pumped through the pumping system exits, may be defined as the outlet side of the pumping system.

The collecting chamber may be positioned on the suction side of the pumping system. This allows the motor and the pumping system to be located remotely relative to the inlet, as the fluid may be drawn in through the inlet by a suction created by the pumping system. The fluid flow may then be filtered by the elongated filter before entering the pumping system, reducing wear on the pumping system and complexity around the inlet. The pumping system may comprise a jet pump. Embodiments of the jet pump is known within the art and will not be described in detail. The jet pump may further protect the pumping system as the filtered fluid may contain the finer debris that may not be desirable to move through the pumping system, e.g., the pump. The pumping system may comprise a pump-filter to protect the pump while it creates an energizing fluid flow for the jet pump, reducing wear on the pump, thereby decreasing maintenance and increasing reliability.

Positioning the collecting chamber on the suction side of the pumping system may limit the pressure difference between an inside of the collecting chamber and the outside (i.e., the wellbore). This may be due to cavitation, net positive suction head, or other factors known in the art. For some types of debris, a larger pressure difference may be desirable. The collecting chamber may be positioned on the discharge side of the pumping system. In this embodiment, the inlet may be a pump inlet or may be connected to the pump inlet. Thus, the pump may be positioned between the inlet and the collecting chamber. This may result in a larger pressure difference between the inside and the outside of the collecting chamber compared to when the collecting chamber is on the suction side of the pumping system. This larger pressure may compress the collected debris, resulting in a better fill-percentage of debris within the collecting chamber.

The characteristics of the debris to be collected from the wellbore may vary between different wellbores, or even between different trips into a specific wellbore. As previously mentioned, the elongated filter may be adapted based on the type of debris being collected from within the wellbore and the deviation of the wellbore. It may be desirable to have the option to replace or adapt the elongated filter between each trip into the wellbore.

The elongated filter may be replaceable. This allows the elongated filter to be adapted between each trip into and out of the wellbore to optimize the elongated filter for the type of debris expected in a subsequent trip into the wellbore. The adaptation of the elongated filter may involve changes to the filter length, the filter diameter, the permeability, or a combination of these features. This flexibility enables the collecting device to be optimized during a collection operation involving a plurality of trips into and out of the wellbore. This ensures efficient and effective debris collection tailored to the specific conditions of each wellbore trip.

The collecting device may comprise at least one fluid sensor. The fluid sensor(s) may be adapted to measure the collecting device's performance data during debris collection. This may be achieved in several ways, all of which provide the operator or an automated system with performance information. The performance information may be derived from a flow rate measurement, and alternatively or additionally, from a differential pressure measurement. The performance information helps determine whether the collecting device is performing adequately for the debris collection task. This allows the operator or the automated system to halt the collecting device when performance reaches a predetermined limit, indicating that efficient collection has ceased. The predetermined limit may be a flow rate, a differential pressure, or a combination of the two. This prevents unnecessary wear on the collecting device and reduces the time the collecting device spends in the wellbore without efficiently collecting debris.

In one embodiment, the fluid sensor may be a permeate fluid sensor fluidly connected between the permeate side of the elongated filter and the outlet. The permeate fluid sensor may be a spinner, a doppler, an ultrasonic sensor, an orifice, or any other fluid sensor capable of measuring a speed of the filtered fluid. The speed of the filtered fluid may be used to calculate its flow rate. A flow rate close to zero indicates that fluid flow through the elongated filter has stopped and collection has ceased. If the measured or calculated flow rate falls below the predetermined limit during debris collection, efficient collection has stopped, and the collecting device may be halted. Positioning the permeate fluid sensor on the permeate side of the elongated filter protects the sensor compared to positioning it in the inlet.

In an embodiment, the fluid sensor may comprise a differential pressure sensor. The differential pressure sensor may have two measuring ends, with the first end fluidly connected to the permeate side of the filter, and the second end fluidly connected to the wellbore fluid surrounding the collecting device. A differential pressure measured between the permeate side of the elongated filter and the wellbore fluid provides information about whether the filter is clogged, which may indicate a full collecting chamber. If the differential pressure is close to zero, the filter is open and provides little fluid resistance and collection may be efficient. A high differential pressure may indicate that the filter is clogged and that the collecting chamber may be full. When the differential pressure reaches the predetermined limit, efficient collection has ceased, and the collecting device may be halted.

In an embodiment, the fluid sensor may be a pressure sensor used to measure a static pressure of the filtered fluid before it exits the outlet into the wellbore. The static pressure may be defined as the pressure sensor being connected to the fluid flow containing the filtered fluid, however the pressure sensor is not positioned inside the fluid flow. The collecting device may also include an environmental fluid sensor, fluidly connected to the wellbore fluid surrounding the collecting device. By comparing the pressure on the permeate side of the elongated filter and the wellbore, the differential pressure may be determined. As mentioned, when the differential pressure reaches the predetermined limit, efficient collection has ceased. By measuring pressures, the sensors are kept from the fluid flow containing the filtered fluid that may comprise the fine debris, thus protecting the fluid sensors that provides a more robust system.

In an embodiment, the collection device may include a combination of fluid sensors designed to measure or calculate the flow rate and the differential pressures. This enhances the accuracy of the predetermined limits, further improving the decision to remove the collection device from the wellbore when efficient collection has ceased.

In a second aspect the invention relates more particularly to a downhole toolstring for collecting debris within a wellbore, the downhole toolstring is adapted to connect to a surface equipment via a cable head and an elongated flexible member, wherein the downhole toolstring comprises the collecting device according to the first aspect of the invention. The cable head may be adapted to connect to an electrical wireline, a coiled tubing provided with an electrical conductor, or a drill pipe provided with an electrical conductor.

In a vertical section of the wellbore, the collecting device may be moved to a location of the debris to be collected, either solely by gravity, by the aid of the elongated flexible member, or by a combination. In this scenario, the collecting device may form the downhole toolstring, thereby maximizing the length of a collecting chamber within the collecting device relative to the available length of the sluice, i.e., the lubricator, which may be used for inserting and removing the downhole toolstring into and out of the wellbore.

All or some of the features of the downhole toolstring described in relation to the first aspect of the invention may be applicable to the second aspect. The features of the downhole toolstring outlined in the second aspect of the invention may also be relevant to the downhole toolstring described in the first aspect.

The downhole toolstring may comprise at least one of, a swivel providing rotational freedom between the elongated flexible member and the downhole toolstring, a release tool for disconnecting a portion of the downhole toolstring, a tension and compression sensor adapted for measuring forces along a device longitudinal central axis, an orientation device for rotating and orientating the collecting device around the device longitudinal central axis, and a propulsion device for providing a propulsive force.

The swivel may permit the downhole toolstring, in whole or in part, to rotate independently from the elongated flexible member, thereby ensuring that no rotational force is transferred between the elongated flexible member and the downhole toolstring.

The release tool may be strategically positioned such as above the upper end portion of the collecting device. This arrangement allows for the salvage of the remaining part of the downhole toolstring if the collecting device becomes lodged within the debris. Alternatively, or additionally, the release tool may be positioned between the elongated flexible member and an upper part of the downhole toolstring such that the elongated flexible member may be salvaged if the downhole toolstring becomes lodged within the debris.

The tension and compression sensor may be employed to monitor forces acting along the longitudinal central axis of the collecting device. This allows for real-time measurements during debris collection, which may help prevent the collecting device from becoming stuck within the debris. This feature is particularly useful when dealing with sticky debris.

The propulsion device, which may be a wireline-operated, may be a tractor, a stroker or a combination. The tractor may be used for rapidly moving the toolstring to a desired location within the deviated part of the wellbore, anchor the toolstring to an internal wall of the wellbore, in addition to provide precise movement and force between the collecting device and the debris to be collected. As the debris is collected inside the collecting device, a leading portion of the collecting device may be moved along the wellbore by the tractor to remain close to, near, or adjacent to the debris to be collected.

The stroker, a well-known device in the art, may comprise an anchor for securing a portion of it to the internal wall of the wellbore. The stroker may also features a linear actuator that provides precise bidirectional force along the device longitudinal central axis, i.e., both a pull and push force. The stroker's potential to exert a significantly greater axial pull and push force surpasses that of the tractor and the elongated flexible member such as coiled tubing, wireline, and slickline. Additionally, the stroker may be equipped with sensors to monitor and measure the axial forces and movement of the linear actuator. If the collecting device becomes lodged in the debris to be collected from the wellbore, the stroker may be utilized to dislodge the collecting device. This significantly reduces the risk of abandoning parts or the entire toolstring in the wellbore, thereby preventing expensive fishing operations.

The orientation device may be used to rotate the collecting device around the device longitudinal central axis. The orientation device may therefore orient components in the collecting device relative to a desired position within the wellbore. The collecting device may comprise an elongated filter positioned in an offset position from the device longitudinal central axis. The orientation tool may rotate and orient the collecting device such that the elongated filter becomes positioned in an uppermost high side position inside the collecting chamber.

The orientation device may be configured to be controlled by an operator via the elongated flexible member. Alternatively, or additionally, the orientation device may be configured to autonomously orient the collecting device to a predetermined orientation around the device longitudinal central axis, eliminating the need for operator intervention. Additionally, if the collecting device is to collect so called "bridges" of debris, i.e., debris deposited in different deposits or sections along the deviated part of the wellbore, the orientation device may, autonomously or be controlled, to maintain the predetermined orientation of the collecting device. This ensures that even if the propulsion device has an uncontrolled rotation around an axis aligned with the device longitudinal central axis, the collecting device is held in the predetermined orientation.

In an embodiment, an inlet of the collecting device may be angled or offset from the device longitudinal central axis. In such a case, it may be beneficial to orient the inlet relative to a feature in the wellbore, such as a side pocket or similar offset geometries where debris may accumulate over time. Moreover, positioning the inlet in the lowermost low side position may facilitate the collection of debris located in the lowermost low side position within a deviated part of the wellbore.

In a third aspect the invention relates more particularly to a method for collecting debris within a wellbore, the method comprises the steps of:

- providing the downhole toolstring comprising a collecting device according to the first aspect of the invention;
- displacing the downhole toolstring into the wellbore such that the leading portion is near or adjacent the debris to be collected;
- collecting the debris from the wellbore within the collecting chamber;
- bringing the collecting device out of the wellbore; and
- emptying the collecting device of the collected debris outside the wellbore.

The term "near or adjacent the debris" may be used interchangeably with "proximate" or "close to". The term "near or adjacent the debris" or "proximate" or "close to" in the context of the leading portion may be defined as a state where the fluid flow about to enter the inlet is sufficient and located such that the debris to be collected may mix or suspend within the fluid flow. This ensures that the debris is effectively captured and transported by the fluid flow. In this context, the leading portion may also be abutting or buried into the debris to be collected. This positioning may allow for direct contact with the debris, enhancing the efficiency of the collection process.

The downhole toolstring may be operated on wireline, slick line, coiled tubing, or drill pipe. In situations where gravity is insufficient to displace the downhole toolstring to the location of the debris within the wellbore, such as in a deviated part of the wellbore, the propulsion device may be incorporated into the downhole toolstring. This propulsion device may be a tractor, such as a wireline-operated tractor, which may navigate the downhole toolstring to the desired location within the wellbore, ensuring effective debris collection. This adaptability allows for efficient operation in a variety of wellbore conditions.

The method may comprise the steps of:

- providing the collecting device with a fluid sensor;
- measuring performance data in the collecting device using the fluid sensor; and
- using the performance data to determine when efficient collection has ceased.

The fluid sensor may be a flow rate sensor, a pressure sensor, or a differential pressure sensor. The fluid sensor generates the performance data, which may be a flow rate, a pressure or a differential pressure. The performance data may be utilized by an operator or an automated system to ascertain when the performance data reaches a predetermined limit. The predetermined limit may indicate that efficient collection has ceased.

The method may comprise the steps of:

- evaluating a fill-percentage of the collected debris within the collecting chamber;
- adapting the elongated filter for the debris to be collected; and
- performing subsequent collection run.

A "collection run" may be defined as a journey or a trip into the wellbore to collect debris, followed by an exit from the wellbore to empty the collecting device.

The "fill-percentage" may refer to a volume of the collected debris in relation to an available collecting volume within a collecting chamber. In some instances, the fill-percentage may be deemed sufficient and acceptable after a collection run, negating the need for any adjustments to the elongated filter.

However, if the fill-percentage is evaluated as insufficient after a collection run, it may be necessary to adapt the elongated filter for the debris to be collected in the subsequent collection run. As outlined in the first aspect of the invention, this adaptation may involve altering at least one of the length of the filter, the diameter of the filter, and the permeability between the first and second end portions of the elongated filter.

The method may comprise the steps of:

- providing the downhole toolstring with an orientation device and a collecting device according to the first aspect of the invention where the elongated filter is positioned offset from the device longitudinal central axis and forms the annular collecting space;
- displacing the downhole toolstring to the deviated part of the wellbore; and
- orientating the collecting device around the device longitudinal central axis such that the elongated filter is positioned in a high side position within the collecting device.

The orientation device may be utilized to rotate and orient the collecting device around the device longitudinal central axis. Embodiments of the orientation device are well-understood by those skilled in the art and will not be described in detail. Positioning the elongated filter towards an uppermost high side position, as detailed in the first aspect of the invention, may enhance the fill-percentage during a collection operation in a deviated section of the wellbore.

The method outlined in the third aspect of the invention may incorporate a downhole toolstring that aligns with the downhole toolstring described in the second aspect of the invention.

Figure 1B:
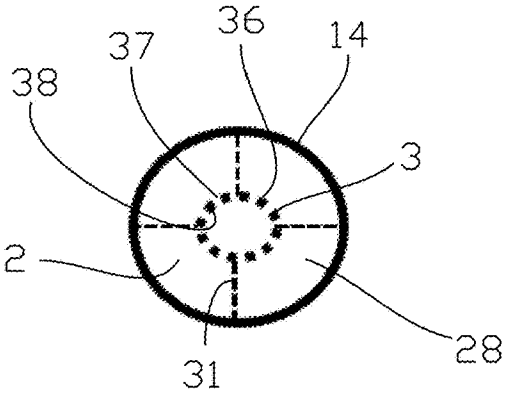
Figure 2A:
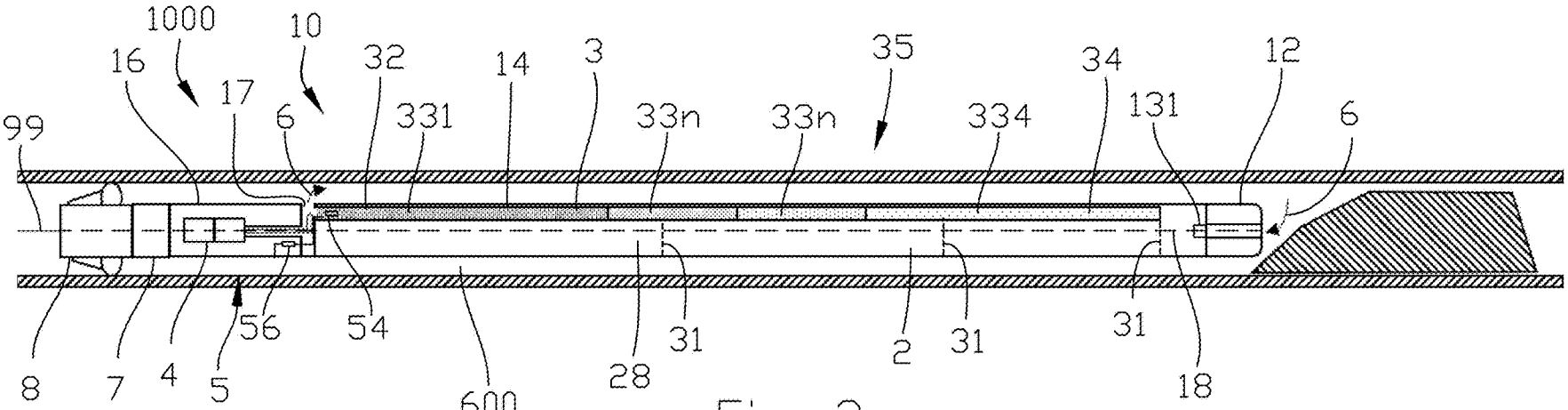
Figure 2B:
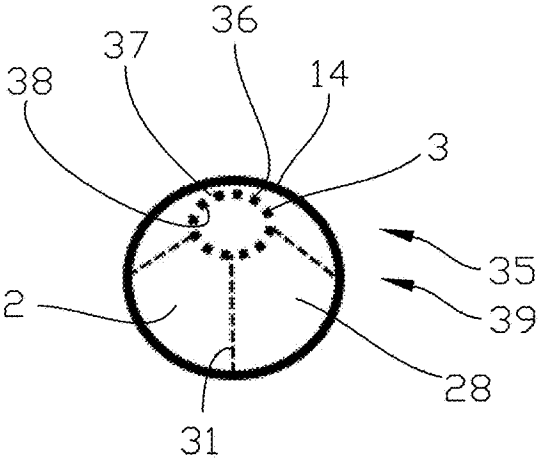
Figure 3A:
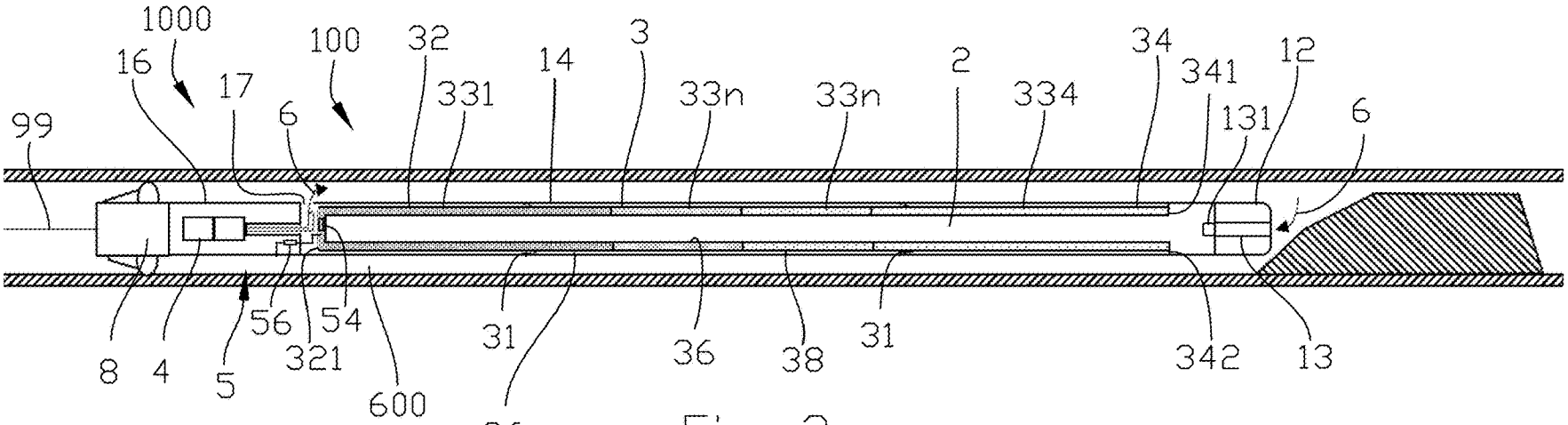
Figure 3B:
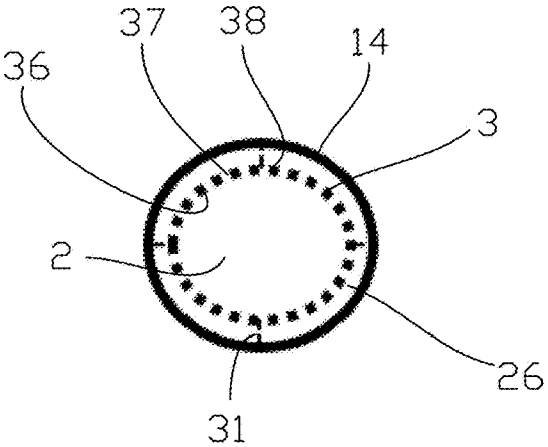
Figure 4A:
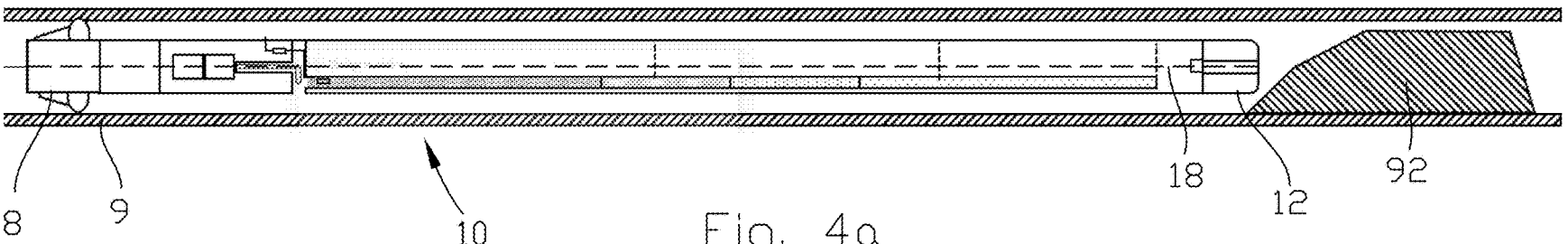
Figure 4B:
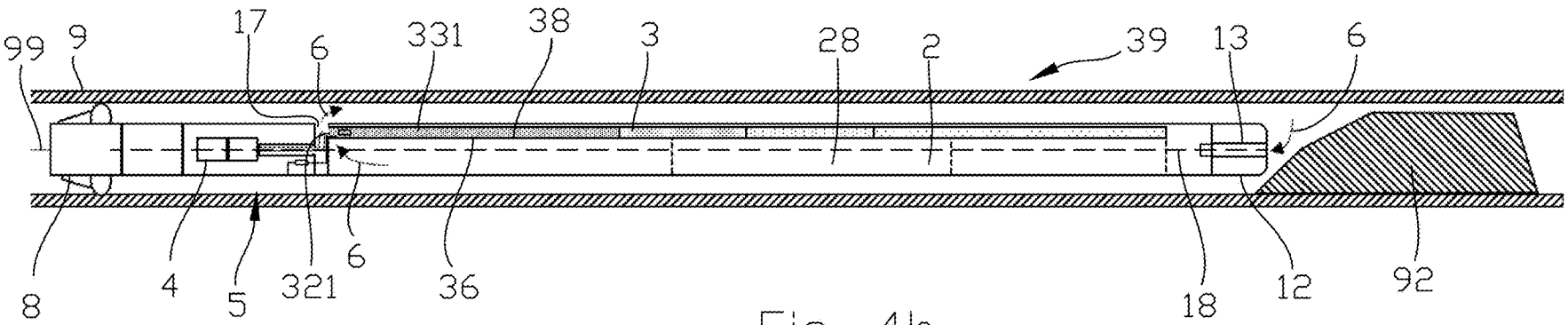
Figure 4C:
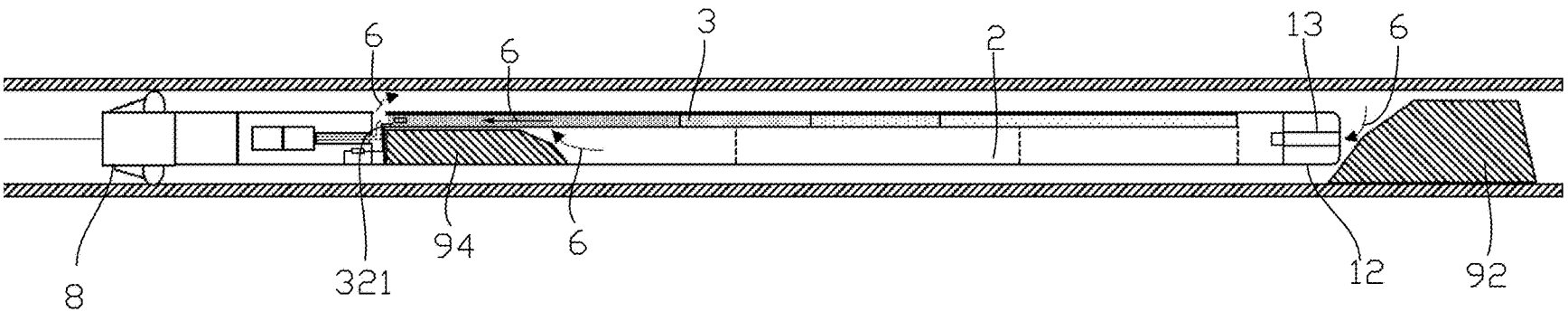
Figure 4D:
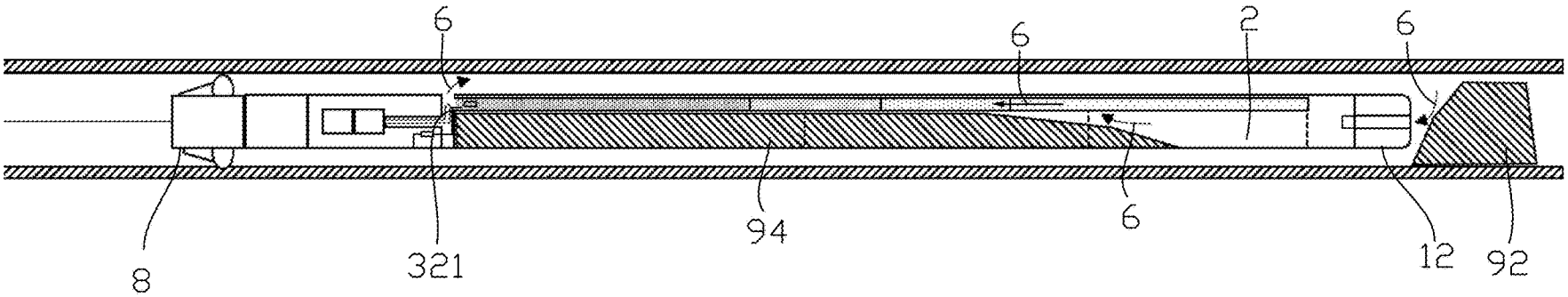
Figure 4E:
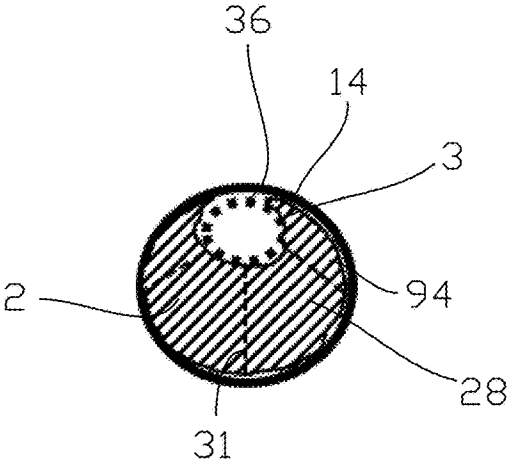
Figure 5A:
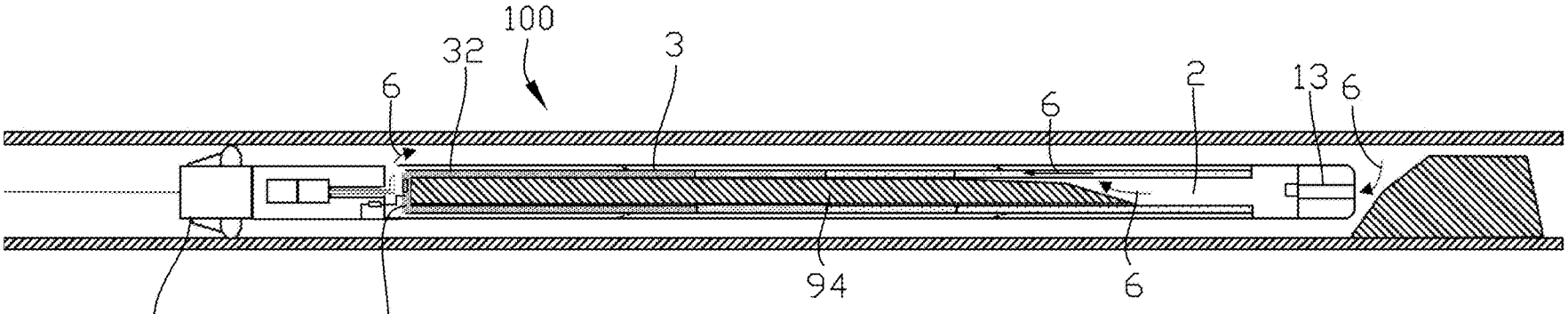
Figure 5B:
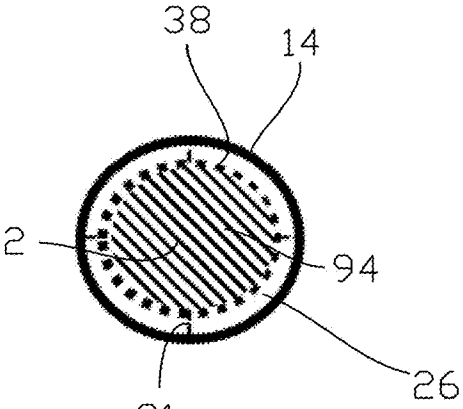

In the following is described examples of preferred embodiments illustrated in the accompanying drawings, wherein:

FIG. 1*a* shows a cross-sectional view along a device longitudinal central axis of a first embodiment of the collecting device, the collecting device forms a part of a downhole toolstring;

FIG. 1*b* shows a cross sectional view perpendicular to the device longitudinal central axis of the first embodiment of the collecting device shown in FIG. 1*a*, but in a different scale;

FIG. 2*a* shows a cross-sectional view along the device longitudinal central axis of a second embodiment of the collecting device, the collecting device forms a part of the downhole toolstring;

FIG. 2*b* shows a cross sectional view perpendicular to the device longitudinal central axis of the second embodiment shown in FIG. 2*a*, but in a different scale;

FIG. 3*a* shows a cross sectional view along the device longitudinal central axis of a third embodiment of the collecting device, the collecting device forms a part of the downhole toolstring;

FIG. 3*b* shows a cross sectional view perpendicular to the device longitudinal central axis of the third embodiment shown in FIG. 3*a*, but in a different scale;

FIGS. 4*a-e* show a method for collecting a debris within a deviated part of a wellbore using the second embodiment of the collecting device and downhole toolstring shown in FIG. 2*a*; and FIGS. 5*a-b* show the third embodiment of the collecting device wherein the debris to be collected has partially been collected and stored within a collecting chamber.

Any positional indications refer to the position shown in the figures. In the figures, same or corresponding elements are indicated by same reference numerals. For clarity reasons, some elements may in some of the figures be without reference numerals. A person skilled in the art will understand that the figures are just principal drawings. The relative proportions of individual elements may also be distorted.

FIG. 1*a* shows a downhole toolstring 1000 comprising the first embodiment of the collecting device 1 for collecting a debris 92 within a deviated part of a wellbore 9. The collecting device 1 comprises a leading portion 12, a trailing portion 16 and a wall 14. The wall 14 connects the leading portion 12 to the trailing portion 16. The collecting device 1 forms a device longitudinal central axis 18. The trailing portion 16 is connected to a propulsion device such as a tractor 8 which is connected to a surface equipment (not shown) via a wireline 99. The tractor 8 is configured for providing a propulsion force to the collecting device 1.

The leading portion 12 comprises an inlet 13 that provides an access from the wellbore 9 and into a collecting chamber 2 within the collecting device 1. The inlet 13 comprises a check valve 131 such as a duckbill valve. A wellbore fluid 600 and the debris 92 to be collected may enter the collecting chamber 2 through the inlet 13. The check valve 131 prevents a collected debris 94 (see FIGS. 4*c-e* and FIGS. 5*a-b*) from exiting the collecting chamber 2 through the inlet 13 and back into the wellbore 9.

The collecting chamber 2 is in the illustrated embodiment formed by the leading portion 12, the wall 14, the trailing portion 16 and an elongated filter 3. The elongated filter 3 may be cylindrical and forms a first end portion 32 and a second end portion 34. The second end portion 34 is positioned closer to the inlet 13 compared to the first end portion 32. The elongated filter 3 comprises a plurality of filter-elements 33 connected head to tail. Each filter-element 33 is identified as "33*n*", wherein n is a numeral for easier identification of a specific filter-element 33. The first end portion 32 of the elongated filter 3 comprises a trailing filter-element 331. The trailing filter-element 331 is connected to the trailing portion 16 in one end and connected to a following filter-element 33*n* in an opposite end. Subsequent following filter elements 33*n* are connected head to tail wherein the last following filter-element 33*n* is connected to a leading filter-element 334. The second end portion 34 of the elongated filter 3 is formed by the leading filter-element 334. The figures show four filter-elements 33 head to tail. The number of filter-elements 33 may be larger than four. The number of filter-elements 33 may be less than four. The trailing filter-element 331 is a coarse filter, i.e. with relative many and large holes or apertures 37 (best seen in FIG. 1*b*) compared to the holes or apertures 37 in the leading filter-element 334. The following filter-elements 33*n* between the leading filter-element 334 and the trailing filter-element 331 increases in a stepwise manner in coarseness such that the trailing filter-element 331 comprises largest holes or apertures 37.

The connected filter-elements 33 forming the elongated filter 3 form a retentate side 36 on one side of the elongated filter 3 and a permeate side 38 on the opposite side of the elongated filter 3. The retentate side 36 and the permeate side 38 is best illustrated in relation to FIG. 1*b*. The retentate side 36 forms an inner boundary of the collecting chamber 2. The permeate side 38 of the elongated filter 3 is fluidly connected to an outlet 17 positioned in the trailing portion 16. The outlet 17 is open to an external surface of the collecting device 1. The outlet 17 therefore provides a fluid connection between the permeate side 38 of the elongated filter 3 and the wellbore 9. The elongated filter 3 extends along the device longitudinal central axis 18 and an annular collecting space 28 is formed between the retentate side 36 and the internal face of the wall 14, thus forming the collecting chamber 2. A plurality of supports 31 keep the elongated filter 3 in position along the device longitudinal central axis 18. The supports 31 are formed by bars extending between the retentate side 36 and the internal face of the wall 14 and create little resistance for fluid and debris flowing past the supports 31. The elongated filter 3 comprises the plurality of holes or apertures 37 between the retentate side 36 and the permeate side 38 of the elongated filter 3. A size and a shape of the holes or apertures 37 influence the permeability of the elongated filter 3.

The trailing portion 16 comprises an electrical motor 4 powered via the wireline 99. The motor 4 is connected to a pumping system 5. The pumping system 5 comprises a jet pump 52. The jet pump 52 is positioned and configured such that the collecting chamber 2 is on a suction side of the pumping system 5. The collecting device 1 operates by the motor 4 providing a rotational force to the pumping system 5. The pumping system 5 creates a fluid flow 6 where the wellbore fluid 600 flows from the permeate side 38 of the elongated filter 3 and out via the outlet 17. The wellbore fluid 600 then flows along the outside of the collecting device 1 towards the inlet 13. Prior to entering the inlet 13, the wellbore fluid 600 may mix with the debris 92 to be collected from within the wellbore 9. The wellbore fluid 600 then enters the collecting chamber 2 via the inlet 13. The wellbore fluid 600 then flows within the collecting chamber 2 towards the first end portion 32 and passes through the elongated filter 3 where permeability is at the largest, i.e. where resistance to flow is at the smallest. The wellbore fluid 600 passes the elongated filter 3 from the retentate side 36 and exits the elongated filter 3 on the permeate side 38. The collected debris 94 remains within the collecting chamber 2 and the wellbore fluid 600 continues out the outlet 17 to complete the fluid flow 6.

The collecting device 1 comprises fluid sensor which is a flow rate sensor 54. The flow rate sensor 54 comprises a spinner situated within the elongated filter 3, thus fluidly connected to the permeate side 38. The flow rate sensor 54 measures a speed of the fluid flow 6, which has traversed through the elongated filter 3 from the retentate side 37 to the permeate side 38 and is flowing towards the outlet 17.

Furthermore, the collecting device 1 comprises a differential pressure sensor 56 fluidly connected to the permeate side 38 of the elongated filter 3 at one end, and fluidly connected to the wellbore fluid 600 surrounding the collecting device 1 at the opposite end. In one embodiment, the differential pressure sensor 56 may be two distinct pressure sensors, one fluidly connected to the permeate side 38, and the other fluidly connected to the wellbore fluid 600. The fluid sensors (54, 56) measures performance date that provide an operator (not shown) with information regarding how efficient the collecting device 1 collects debris.

A downhole toolstring 1000 comprising a second embodiment of the collecting device 10 is shown in FIGS. 2*a-b*. The collecting device 10 is connected to an orientation device 7 and the propulsion device such as the tractor 8. The orientation device 7 is configured to orientate the collecting device 10 around the device longitudinal central axis 18. A filter longitudinal axis of the elongated filter 3 is in the first embodiment concentric with the device longitudinal central axis 18 of the collecting device 1 (FIGS. 1*a-b*). In the second embodiment of the collecting device 10, the filter longitudinal axis of the elongated filter 3 is eccentric with the device longitudinal central axis 18 of the collecting device 10. Thus, the difference between the first embodiment of the collecting device 1 and the second embodiment of the collecting device 10 is that the elongated filter 3 is positioned in an offset position 35 from the device longitudinal central axis 18. The offset position 35 is kept by the supports 31 providing the support between the internal face of the wall 14 and the retentate side 36 of the elongated filter 3. The collecting device 10 comprises the flow rate sensor 54 and the differential pressure sensor 56 in the same manner as in the first embodiment of the collecting device 1.

FIG. 2*b* shows that the orientation device 7 has orientated the collecting device 10 such that the elongated filter 3 is positioned in an uppermost high side position 39 within the collecting device 10, i.e., a 12 o'clock position. Orientation of the collecting device 10 may be initiated by a command transmitted through the wireline 99 from the surface. Additionally, or alternatively, the orientation device 7 may be adapted to automatically rotate the collecting device 10 around the device longitudinal central axis 18 to a predetermined position, for instance, the uppermost high side position 39.

FIGS. 3*a-b* show the downhole toolstring 1000 comprising a third embodiment of the collecting device 100. The elongated filter 3 is configured to create an annular clean space 26 between the permeate side 38 of the elongated filter 3 and the internal face of the wall 14. The supports 31 provide support between the internal face of the wall 14 and the permeate side 38 of the elongated filter 3 such that the elongated filter 3 maintains its position within the collecting device 100. The annular clean space 26 is formed between a first end 321 of the elongated filter 3 and a second end 341 of the elongated filter 3, the second end 341 being positioned nearest the inlet 13. The first end 321 is in an opposite end of the elongated filter 3 relative to the second end 341. The second end 341 of the elongated filter 3 comprises an end wall 342 positioned between the retentate side 36 of the elongated filter 3 and the internal face of the wall 14 such that the collected debris 94 (see FIG. 5*a*) may not enter the annular clean space 26.

The collecting device 100 comprises the flow rate sensor 54 and the differential pressure sensor 56. The flow rate sensor 54 is strategically positioned and fluidly connected on the permeate side 38 of the elongated filter 3 such that the flow rate sensor 54 may measure the speed of the filtered fluid after exiting the elongated filter 3 on the permeate side 38. The differential pressure sensor 56 is fluidly connected to the permeate side 38 of the elongated filter 3, and to the wellbore fluid 600 surrounding the collecting device 100.

FIGS. 4*a-e* show a method for collecting the debris 92 to be collected within the wellbore 9 using the second embodiment of the collecting device 10.

FIG. 4*a* shows that the tractor 8 has displaced the collecting device 10 such that the leading portion 12 is positioned near the debris 92 to be collected within the wellbore 9. The elongated filter 3 is positioned in a lowermost low side position, i.e., the 6 o'clock position, within the collecting device 10.

FIG. 4*b* shows that the orientation device 7 has been activated and has rotated the collecting device 10 around the device longitudinal central axis 18 such that the elongated filter 3 is positioned in the uppermost high side position 39, i.e., the 12 o'clock position. The motor 4 provides the pumping system 5 with a rotational force such that the fluid flow 6 is created and the wellbore fluid 600 flows from the outlet 17 and along the outside of the collecting device 10 towards the leading portion 12. Before the fluid flow 6 enters the inlet 13, the wellbore fluid 600 mixes with the debris 92 to be collected within the wellbore 9. The fluid flow 6 containing the debris 92 continues in through the inlet 13 and into the collecting chamber 2. The fluid flow 6 enters the retentate side 36 of the trailing filter-element 331 near the first end 321 where the permeability is largest and resistance to flow is at the smallest. The fluid flow 6 then passes the elongated filter 3 and exits the permeate side 38 before the fluid flow 6 continues to the outlet 17 and into the wellbore 9.

FIG. 4*c* shows that the collecting device 10 has collected an amount of collected debris 94 within the collecting chamber 2. The collected debris 94 has settled within the collecting chamber 2 near the first end 321, i.e., in an opposite end of the collecting chamber 2 relative to the inlet 13. The tractor 8 has displaced the collecting device 10 such that the leading portion 12 remains close to or proximate the debris 92 as the debris 92 within the wellbore 9 is being collected within the collecting chamber 2. The fluid flow 6 enters the elongated filter 3 through the retentate side 36 at a distance from the first end 321 due to the collected debris 94 clogging a portion of the elongated filter 3 near the first end 321.

FIG. 4*d* shows that a larger portion of the collected debris 94 has been collected within the collecting chamber 2. More collected debris 94 within the collecting chamber 2 clogs a larger portion of the retentate side 36 of the elongated filter 3 compared to FIG. 4*c*. The fluid flow 6 therefore enters the elongated filter 3 through the retentate side 36 at a larger distance from the first end 321 compared to the situation shown in FIG. 4*c*. The tractor 8 has displaced the collecting device 10 further into the wellbore 9 compared to FIG. 4*c* such that the leading portion 12 is still close to or proximate the debris 92 to be collected.

FIG. 4*e* shows that the collected debris 94 has been collected in the annular collecting space 28 between the retentate side 36 and the wall 14.

As seen in FIGS. 4*b-d*, the collected debris 94 starts accumulating close to the first end 321 of the elongated filter 3 and then continues accumulating towards the inlet 13. This ensures that the collecting chamber 2 becomes fully filled if there is a surplus of debris 92 within the wellbore 9.

FIGS. 5*a-b* show how the third embodiment of the collecting device 100 collects and store the collected debris 94 within the collecting chamber 2. As previously described, the permeability in the first end portion 32 of the elongated filter 3 is larger compared to the second end portion 34. FIG. 5*a* shows that the collected debris 94 first accumulates close to the first end 321 of the elongated filter 3 and then progressively accumulates towards the inlet 13 in the same manner as described in FIGS. 4*b-d*.

FIG. 5*b* shows that the collected debris 94 is collected and stored within the elongated filter 3. The annular clean space 26 surrounds the collecting chamber 2 in the illustrated cross section. The supports 31 are positioned between the permeate side 38 of the elongated filter 3 and the internal face of the wall 14 within the annular clean space 26 and the supports 31 are therefore no restriction to the collected debris 94.

Comparison of the first embodiment of the collecting device 1 or of the second embodiment of the collecting device 10 with the third embodiment of the collecting device 100, shows that the filter-area is substantially larger in the third embodiment.

The technical effect of controlling the fluid flow 6 such that the collected debris 94 initially settles near the first end 321 of the elongated filter 3 in the opposite end of the inlet 13 and progressively collecting the collected debris 94 towards the inlet 13, are present in all three embodiments of the collecting device 1, 10, 100. Thus, the collecting device 1, 10, 100 provide adaptable, repeatable, and predictable performance with a high fill percentage during collection of debris.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A collecting device for collecting debris within a wellbore, the collecting device comprises:

a leading portion, an opposite trailing portion, a wall connecting the leading portion to the trailing portion;

a collecting chamber on an inside of the wall, an inlet at the leading portion, an outlet at the trailing portion, and an elongated filter;

the collecting device forms a device longitudinal central axis between the leading portion and the trailing portion;

the elongated filter extends along the device longitudinal central axis and forms a first end portion and an opposite second end portion, wherein the elongated filter at the first end portion is formed with a first permeability and the elongated filter at the second end portion is formed with a second permeability;

the second end portion is positioned closest to the inlet;

the elongated filter forms a retentate side and a permeate side; and the permeate side of the elongated filter is fluidly connected with the outlet;

the first and second permeabilities pre-selected to define a fluid flow path to control displacement of collected debris within the collecting chamber, the collected debris settling toward the first end and then progressively settling toward the inlet.

2. The collecting device according to claim 1, wherein the elongated filter comprises a plurality of intermediate permeability regions between the first end portion and the second end portion.

3. The collecting device according to claim 1, wherein the first permeability is larger compared to the second permeability.

4. The collecting device according to claim 1, wherein the inlet comprises a duckbill valve.

5. The collecting device according to claim 1, wherein an annular collecting space is formed between the retentate side of the elongated filter and the wall.

6. The collecting device according to claim 5, wherein the elongated filter is in an offset position from the device longitudinal central axis.

7. The collecting device according to claim 6, wherein the collecting device comprises a support, the support being adapted to maintain the offset position of the elongated filter and/or to adjust the offset position of the elongated filter from the device longitudinal central axis.

8. The collecting device according to claim 1, wherein an annular clean space is formed between the permeate side of the elongated filter and the wall.

9. The collecting device according to claim 1, wherein the collecting device comprises a pumping system configured to form a fluid flow from the wellbore and into the collecting chamber via the inlet.

10. The collecting device according to claim 9, wherein the collecting device comprises a motor adapted to energise the pumping system.

11. The collecting device according to claim 9, wherein the collecting chamber is positioned remote from the motor on a suction side of the pumping system.

12. The collecting device according to claim 9, wherein the pumping system comprises a jet pump.

13. The collecting device according to claim 9, wherein the collecting chamber is positioned on a discharge side of the pumping system.

14. The collecting device according to claim 1, wherein the elongated filter is replaceable.

15. The collecting device according to claim 1, wherein collecting device comprises a fluid sensor adapted to measure performance data during use.

16. A downhole toolstring for collecting debris within a wellbore, the downhole toolstring is adapted to connect to a surface equipment via an elongated flexible member, wherein the downhole toolstring comprises:

a collecting device comprising:

a leading portion, an opposite trailing portion, a wall connecting the leading portion to the trailing portion, a collecting chamber on an inside of the wall, an inlet at the leading portion, an outlet at the trailing portion, and an elongated filter;

the collecting device forms a device longitudinal central axis between the leading portion and the trailing portion;

the elongated filter extends along the device longitudinal central axis and forms a first end portion and an opposite second end portion, wherein the elongated filter at the first end portion is formed with a first permeability and the elongated filter at the second end portion is formed with a second permeability;

the second end portion is positioned closest to the inlet;

the elongated filter forms a retentate side and a permeate side;

the permeate side of the elongated filter is fluidly connected with the outlet; and the first and second permeabilities pre-selected to define a fluid flow path to control displacement of collected debris within the collecting chamber, the collected debris settling toward the first end and then progressively settling toward the inlet.

17. The downhole toolstring according to claim 16, wherein the downhole toolstring comprises at least one of a swivel providing rotational freedom between the elongated flexible member and the downhole toolstring, a release tool for disconnecting a portion of the downhole toolstring, a tension and compression sensor adapted for measuring forces along the device longitudinal central axis, an orientation device for rotating and orientating the collecting device around the device longitudinal central axis, and a propulsion device for providing a propulsive force.

18. The downhole toolstring according to claim 17, wherein the propulsion device is at least one of a wireline operated tractor and a wireline operated stroker.

19. The downhole toolstring according to claim 17, wherein the orientation device is configured to be controlled by an operator via the elongated flexible member, or to autonomously orient the collecting device to a predetermined orientation around the device longitudinal central axis.

20. A method for collecting debris within a wellbore, the method comprises the steps of:

providing a downhole toolstring comprising a collecting device, the collecting device comprising: a leading portion, an opposite trailing portion, a wall connecting the leading portion to the trailing portion, a collecting chamber on an inside of the wall, an inlet at the leading portion, an outlet at the trailing portion, and an elongated filter; the collecting device forms a device longitudinal central axis between the leading portion and the trailing portion; the elongated filter extends along the device longitudinal central axis and forms a first end portion and an opposite second end portion, wherein the elongated filter at the first end portion is formed with a first permeability and the elongated filter at the second end portion is formed with a second permeability; the second end portion is positioned closest to the inlet; the elongated filter forms a retentate side and a permeate side; and the permeate side of the elongated filter is fluidly connected with the outlet, the first and second permeabilities being pre-selected to define a fluid flow path to control displacement of collected debris within the collecting chamber, displacing the downhole toolstring into the wellbore such that the leading portion is near or adjacent the debris to be collected;

collecting the debris from the wellbore within the collecting chamber, the collected debris settling toward the first end and then progressively settling toward the inlet;

bringing the collecting device out of the wellbore; and emptying the collecting device of collected debris outside the wellbore.

21. The method according to claim 20, wherein the method comprises the steps of:

providing the collecting device with a fluid sensor;

measuring performance data in the collecting device using the fluid sensor; and using the performance data to determine when efficient collection has ceased.

22. The method according to claim 20, wherein the method comprises the steps of:

evaluating a fill-percentage of the collected debris within the collecting chamber;

adapting the elongated filter for the debris to be collected; and performing a subsequent collection run.

23. The method according to claim 20, wherein the method further comprises the steps of:

displacing the downhole toolstring to a deviated part of the wellbore; and orientating the collecting device around the device longitudinal central axis such that the elongated filter in an offset position is positioned in a high side position within the collecting device.

* * * * *